US007287383B2

(12) United States Patent
Bunel et al.

(10) Patent No.: US 7,287,383 B2
(45) Date of Patent: Oct. 30, 2007

(54) AFTERBURNER ARRANGEMENT

(75) Inventors: Jacques Bunel, Fresnes (FR); Jacques Roche, Lisses (FR); Bien-Aimé Rakotondrainibe, Arbonne la Foret (FR); Stéphane Touchaud, Paris (FR)

(73) Assignee: SNECMA Moteurs, Paris (FR)

( * ) Notice: Subject to any disclaimer, the term of this patent is extended or adjusted under 35 U.S.C. 154(b) by 555 days.

(21) Appl. No.: 10/898,999

(22) Filed: Jul. 27, 2004

(65) Prior Publication Data

US 2005/0086941 A1 Apr. 28, 2005

(30) Foreign Application Priority Data

Aug. 5, 2003 (FR) ..... 03 09657

(51) Int. Cl.
*F02K 3/10* (2006.01)

(52) U.S. Cl. ..... 60/762; 60/765

(58) Field of Classification Search ..... 60/761, 60/762, 763, 765, 766, 796
See application file for complete search history.

(56) References Cited

U.S. PATENT DOCUMENTS 2,862,359 A * 12/1958 Spears ..... 60/765
3,269,116 A * 8/1966 Frasca et al. ..... 60/765
4,724,671 A * 2/1988 Lapergue et al. ..... 60/763
5,127,224 A * 7/1992 Barcza et al. ..... 60/763

FOREIGN PATENT DOCUMENTS

| | | |
|---|---|---|
| FR | 1.321.385 | 3/1963 |
| FR | 2 696 502 | 4/1994 |
| FR | 2 770 284 | 4/1999 |

* cited by examiner

*Primary Examiner*—L. J. Casaregola
(74) *Attorney, Agent, or Firm*—Oblon, Spivak, McClelland, Maier & Neustadt, P.C.

(57) ABSTRACT

The invention relates to a burner ring for turbofan jet engines. The ring includes an upstream annular envelope which forms a channel which is open axially in the downstream direction, and a manifold for injecting fuel into the channel. The ring includes multiple sectors connected together. Each sector has a fuel inlet which is connected to the fuel injection manifold. Part of the upstream annular envelope is in the core flow. Each sector has a connector which receives the fuel inlet and a ventilation duct which extends through the channel and upstream of the injection manifold. Each sector is fitted with an inlet for a bypass air, which air is then emitted by the ventilation duct to cool the injection manifold. A sector of downstream annular envelope is arranged downstream of the injection manifold to protect this manifold.

16 Claims, 5 Drawing Sheets

Fig.7
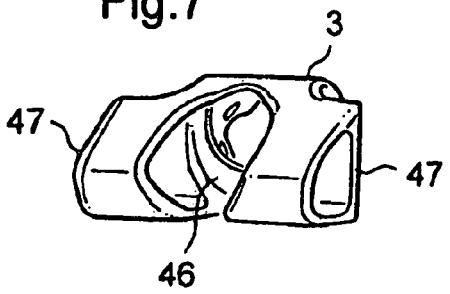
Fig.8
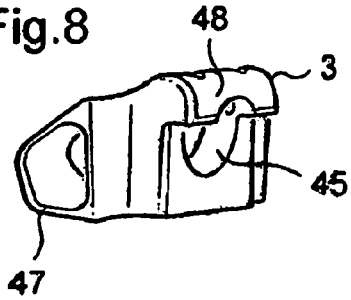
Fig.9
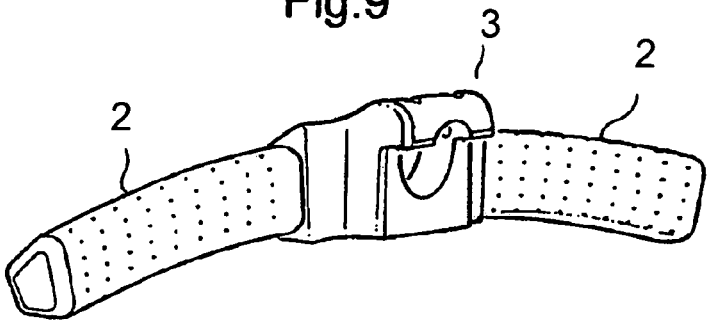
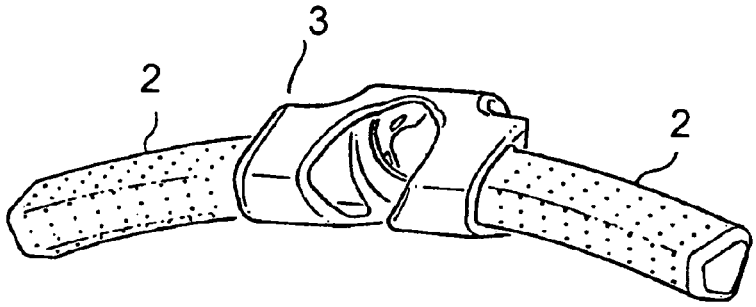
Fig.10

AFTERBURNER ARRANGEMENT

The invention relates to the field of turbofan jet engines and more particularly to afterburner arrangements.

Turbofan jet engines have a flow of exhaust gases termed the core flow which is at a higher temperature than a flow of air termed the bypass flow. It is known that turbofan jet engines have an afterburner arrangement. This latter comprises an annular outer casing having, within it, an annular exhaust casing which is spaced away from the annular outer casing and which comprises annular inner and outer walls whose axis of revolution is the same as the axis of rotation of the jet engine. The outer wall and the annular outer casing define a passage for the bypass flow, and the annular outer wall and the annular inner wall define a passage for the core flow. After first combustion which releases the flow of exhaust gases (the core flow) through the high-pressure and low-pressure turbines, the engine has an arrangement which employs the injection of fuel into the core flow and the bypass flow to initiate second combustion. There are known afterburner arrangements which comprise a burner ring situated in the bypass flow, and flameholder arms which are situated in the core flow where the latter has been mixed with part of the bypass flow. There are also known afterburner arrangements which comprise a burner ring situated in the core flow. The result of these positions is high thermal stresses.

The present invention proposes to improve the afterburner arrangement.

The invention relates to an afterburner ring for turbofan jet engines, a flow of exhaust gases termed the core flow being at a higher temperature than a flow of air termed the bypass flow, the ring having an axis of revolution suitable for being positioned to coincide with the axis of rotation of the jet engine, the ring comprising on the one hand an upstream annular envelope forming a channel which is open axially in the downstream direction, and on the other hand a fuel injection manifold arranged in the channel, the ring being formed by a plurality of sectors of ring which are connected together and which each comprise a sector of the upstream annular envelope, each sector of the upstream annular envelope being fitted with a fuel inlet which is connected to the fuel injection manifold.

According to a main feature of the invention, the upstream (or outer) surface of the upstream annular envelope is suitable for being in contact with the core flow. What is more, each sector of ring comprises a connecting means which is arranged in the channel at a point upstream of the fuel injection manifold to receive on the one hand the fuel inlet and on the other hand a ventilation duct which extends along the channel, for at least part of the length of the upstream annular envelope, at a point upstream of the fuel injection manifold, each sector of the upstream annular envelope being provided with an inlet for bypass air, which air is then emitted by the ventilation duct to cool the fuel injection manifold. Also, a sector of downstream annular envelope is arranged downstream of the fuel injection manifold to protect the latter.

The invention also relates to an afterburner arrangement for turbofan jet engines, a flow of exhaust gases termed the core flow being at a higher temperature than a flow of air termed the bypass flow, the arrangement comprising an annular outer casing having, within it, an annular exhaust casing which is spaced away from the annular outer casing and which comprises annular inner and outer walls whose axis of revolution is the axis of rotation of the jet engine, the outer wall and the annular outer casing defining a passage for the bypass flow and the annular outer wall and the annular inner wall defining a passage for the core flow, the arrangement also comprising flameholder arms.

In accordance with a main feature of the invention, the outer wall has orifices and the arrangement comprises the afterburner ring as previously defined, which is fixed to the annular outer wall in such a way that the upstream surface of the upstream annular envelope is in contact with the core flow and that the inlet for bypass air belonging to each sector of the upstream annular envelope coincides with an orifice in the outer wall.

The accompanying drawings show embodiments of the invention by way of non-limiting example. In the drawings:

FIG. 7 is a perspective view of the connecting end-piece looking from upstream.

FIG. 8 is a perspective view of the connecting end-piece looking from downstream.

FIG. 9 is a perspective view, looking from downstream, of the connecting end-piece when connected to the ventilation duct.

FIG. 10 is a perspective view, looking from upstream, of the connecting end-piece when connected to the ventilation duct.

The drawings contain, in the main, items which are of a set nature. They can therefore serve not only to enable the description to be better understood but also to assist, where applicable, in defining the invention.

Figure 1A:
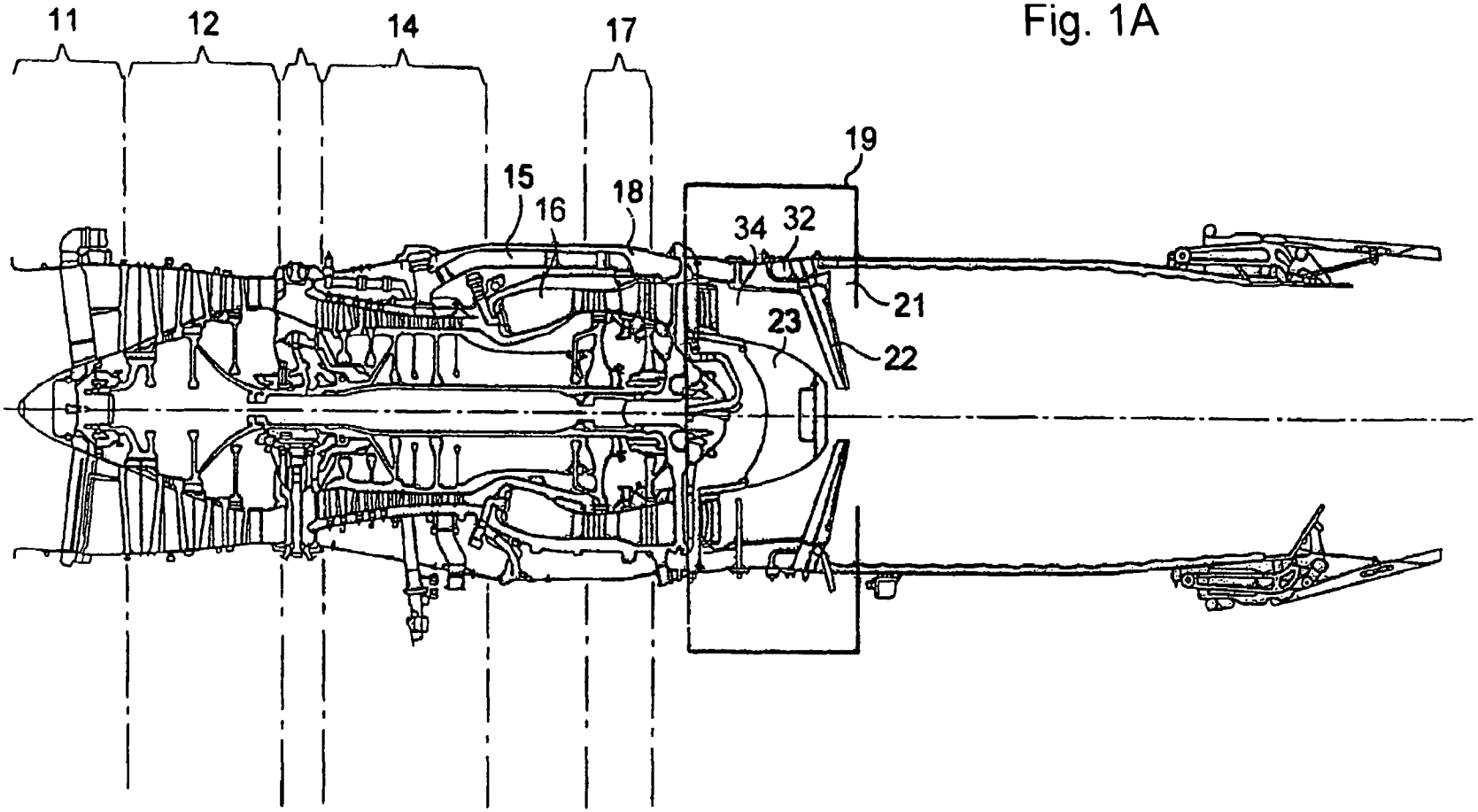
FIG. 1A is a view in section of a turbofan jet engine.

FIG. 1A is a diagram of a turbofan jet engine.

The air is first drawn in by the intake fan 11 and is then directed into the low-pressure compressor 12. One part of the flow of air which has been compressed is directed into the high-pressure compressor 14 and the other part into part 18 of the engine. On leaving the combustion chamber 16, the exhaust gases are directed into the high-pressure turbine and then the low-pressure turbine 17 before being directed into the exhaust casing 23. These high-temperature exhaust gases represent a core flow. The flow of cold air in part 18 of the turbofan is heated by contact with the passage 15 for hot air. The heated flow of air is called the bypass flow.

Figure 1B:
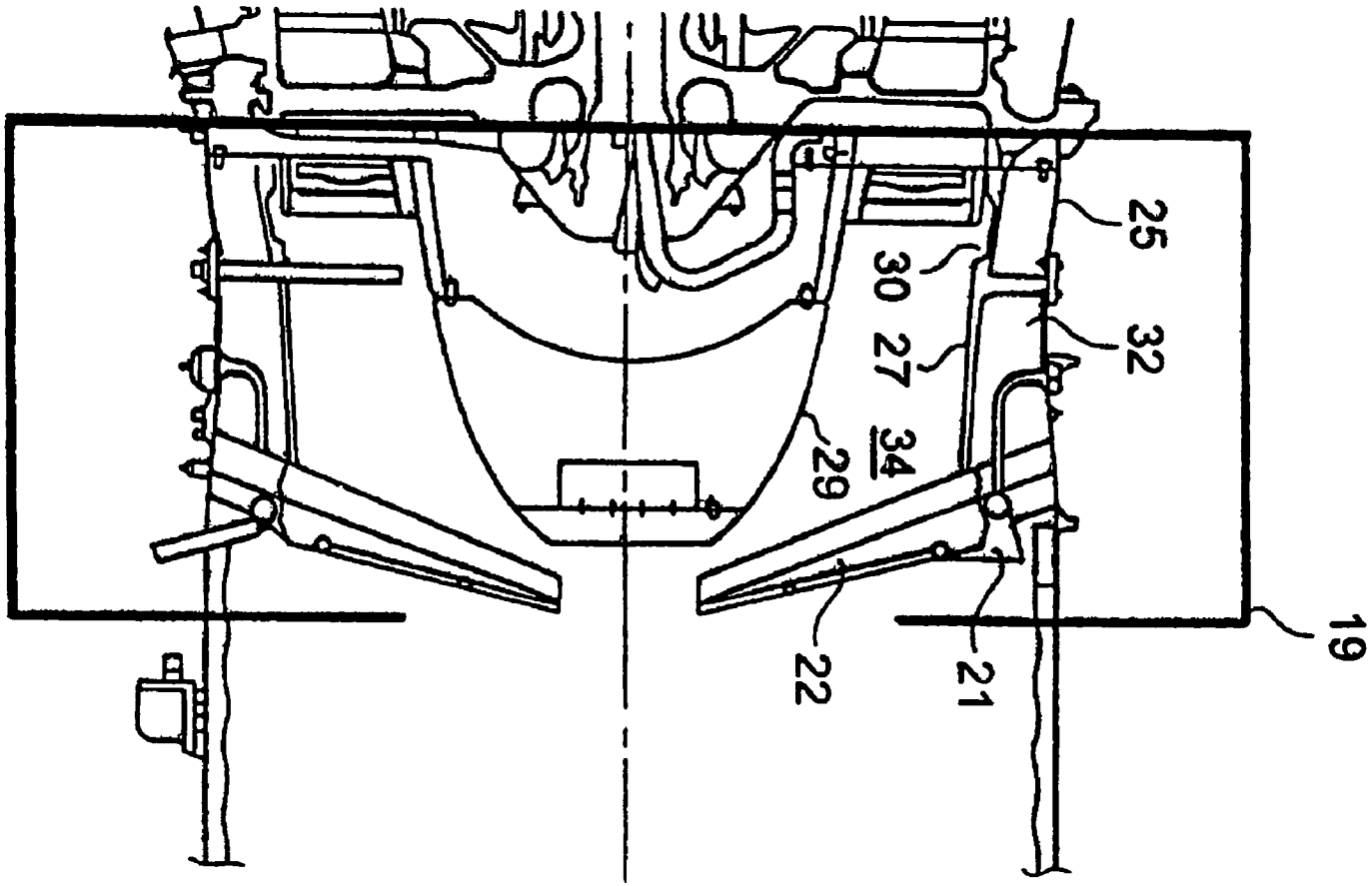
FIG. 1B shows a detail of the section through a turbofan jet engine which is shown in FIG. 1A.

The afterburner arrangement 19 will now be explained by reference to the detail view in FIG. 1B. The afterburner arrangement comprises an annular outer casing 25 which has, within it and at a distance from it, an annular exhaust casing. The two casings have the same axis of revolution, which is the same as the axis of rotation of the jet engine. The annular exhaust casing comprises an annular inner wall 29 and an annular outer wall 27, the axis of revolution of these walls is the axis of rotation of the engine, the annular outer wall 27 and the annular outer casing 25 defining a passage 32 for the bypass flow after it has passed through part 18, the annular outer wall 27 and the annular inner wall 29 defining a passage 34 for the core flow after it has passed through the turbines 17. An orifice 30 in the annular outer wall 27 allows a passageway to be left open to enable the bypass flow to mix with the core flow in the passage 34. A fuel inlet mechanism in the passage 34 enables the core-flow/bypass flow/fuel mixture to be caused to burn, the flames attaching themselves to the flameholder arms 22. As indicated in FIG. 1B, the arms are connected to the annular outer casing and extend downstream at an angle of inclination to a plane perpendicular to the axis of rotation. What is more, a burner ring 21 is positioned in the bypass flow and is made up of sectors of ring arranged between the flameholder arms. The upstream annular envelope of the burner ring protects a fuel injection manifold, which sprays fuel in the downstream direction to maintain the afterburning, against the afterburner flames and against the high-temperature (900° C.) core flow.

To improve the efficiency of the afterburning, the burner ring is positioned in the core flow. This arrangement gives rise to very high thermal stresses at the burner ring. Therefore, in accordance with the invention, the latter is produced in such a way that the thermal stresses are reduced and the efficiency of the afterburning improved.

Figure 6:
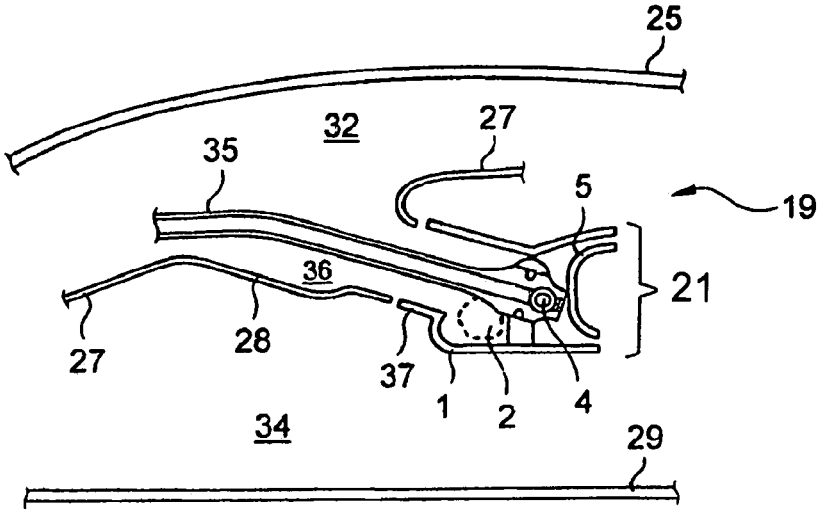
FIG. 6 is a schematic general arrangement drawing of the afterburner arrangement, which here comprises only the burner ring according to the invention.

FIG. 6 is a schematic section through the afterburner arrangement according to the invention. The arrangement comprises a burner ring which comprises on the one hand an upstream annular envelope forming a channel which is open axially in the downstream direction, and on the other hand a fuel injection manifold 4 arranged in the channel, the burner ring 21 being formed by a plurality of sectors of ring which are connected together and which each comprise a sector 1 of the upstream annular envelope, each sector 1 of the upstream annular envelope being fitted with a fuel inlet 35 which is connected to the fuel injection manifold 4. Solely by way of example, the upstream annular envelope is formed by an annular dihedral whose rounded apex is directed upstream, the inner plane of the dihedral being parallel to the axis of rotation and the outer plane being directed radially outwards. As shown in FIG. 6, the annular outer wall 27 contains, in a plane perpendicular to the axis of rotation, orifices 36 which are regularly spaced around the entire circumference of the outer annular wall 27. These orifices 36 are defined by a section of tube 28 extending downstream, said open-ended section of tube 28 being, by, way of example in one piece with the inner annular wall 27 by casting. The section of tube 28 extends downstream at an angle of inclination to a plane perpendicular to the axis of rotation. Each sector of the upstream annular envelope of the burner ring, and more particularly each outer plane of each sector, contains an orifice which is defined by a section of tube 37 which extends upstream at an angle of inclination to a plane perpendicular to the axis of rotation. The orifice in the sector of the upstream annular envelope is adapted to coincide with and to be fixed to one of the orifices in the outer annular wall 27.

Figure 1C:
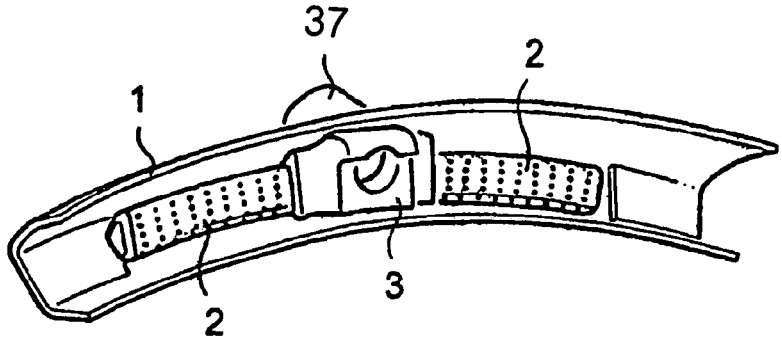
FIG. 1C is a perspective view of a sector of burner ring in a first phase of assembly according to the invention.
Figure 2:
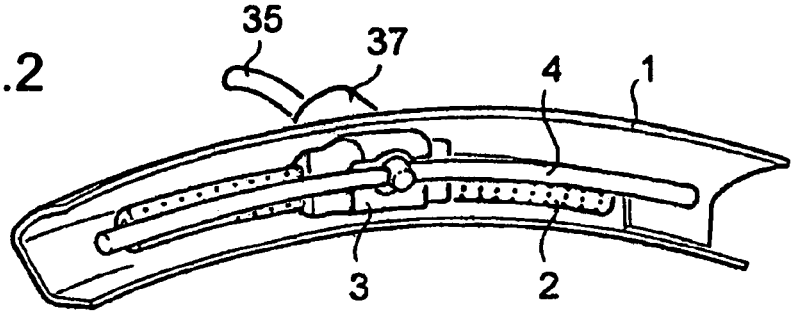
FIG. 2 is a perspective view of a sector of burner ring in a second phase of assembly according to the invention.

The orifice in the sector of the upstream annular envelope acts as an inlet for bypass air and an inlet for fuel into the channel formed by the sector of the upstream annular envelope. Another embodiment of the orifices could be envisaged to enable the air inlet to be dissociated from the fuel inlet. The inlet of fuel takes place more particularly through a tube 35 which passes through the coincident orifices in the annular outer wall and the sector of the upstream annular envelope. At its end, the tube 35 opens into a connecting head, which head is connected to the fuel injection manifold arranged in the channel defined by the sector of the upstream annular envelope. The fuel injection manifold 4 extends over at least a part of the sector 1 of the upstream annular envelope and is formed by a tube which is perforated in the downstream direction. In the very high-temperature environment resulting from the position of the burner ring in the core flow, it is necessary for each sector of the burner ring to be ventilated and cooled to avoid excessively high thermal stresses. To improve the ventilation of the upstream annular envelope and the fuel injection manifold, a ventilation duct 2 is arranged in the channel at a point upstream of the fuel injection manifold 4 and is fed by the air inlet. FIG. 1C shows the fitting of the ventilation duct into the channel, prior to the fitting of the fuel injection manifold which is shown in FIG. 2. Each tube of the ventilation duct is provided with local bosses, termed studs, to ensure there is a gap between the sector of upstream annular envelope and the ventilation duct.

Each sector of burner ring has a connecting end-piece 3 which is arranged in the channel at a point upstream of the fuel injection manifold, to receive on the one hand the fuel inlet pipe and the air inlet, and on the other hand the ventilation duct, which latter extends along the channel for at least part of the length of the sector of the upstream annular envelope and at a point upstream of the fuel injection manifold. The connecting end-piece is shown in detail particularly in FIGS. 7, 8, 9 and 10.

The shape of the connecting end-piece 3 is complementary to that of the channel formed by the upstream annular envelope to allow it to be positioned upstream of the fuel injection manifold. The end-piece contains a main cavity 46 which is able to be positioned opposite the orifice in the sector of the upstream annular envelope and which is able to receive the connecting head of the fuel inlet and air inlet. The main cavity opens onto a downstream opening 45 to enable the connecting head to be connected to the fuel injection manifold, which latter is arranged perpendicularly to the direction of the connecting head. To stop the connecting head from rotating in the cavity which opens onto the downstream opening, the connecting end-piece 3 has a projection 48 which extends axially and is positioned radially outwards from the downstream opening. The connecting end-piece 3 also has lateral openings 47, that is to say openings at opposite ends which face in the direction of the circumference of the ring on either side of the main air inlet cavity. The lateral openings 47 enable the ventilation duct to be fitted. The ventilation duct advantageously comprises two multiply perforated hollow ventilation tubes each adapted to be held at their open end in one of the two lateral openings, the free ends of the ventilation tubes opening into the main cavity. The air which enters through the orifice 37 in the sector of the upstream annular envelope passes into the main cavity, which forms an air inlet receptacle, and is directed laterally and circumferentially into the hollow ventilation tubes of the ventilation duct 2 through the ends of the hollow ventilation tubes which are positioned in the lateral openings 47 in the connecting end-piece 3.

To protect the fuel injection manifold and the ventilation duct from flash-backs and radiant heat, a sector 5 of downstream annular envelope is arranged downstream of the said manifold in the channel defined by the sector of upstream annular envelope. The sector of downstream annular envelope is broadly semi-circular in axial section, the ends of the axial section forming, with respective ends of the planes of the downstream annular envelope, passages for the fuel coming from the fuel injection manifold. The sector 5 of downstream annular envelope forms a screen for the thermal protection of the burner ring in the downstream direction.

Figure 3:
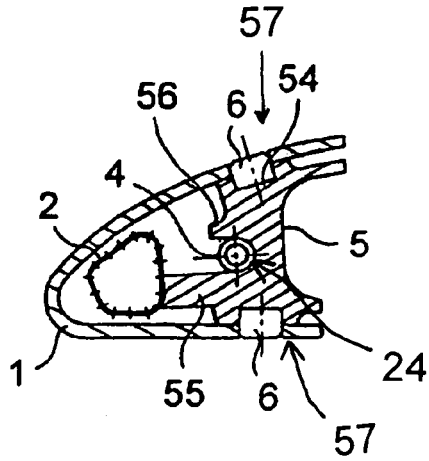
FIG. 3 is a section through the sector of burner ring on line A-A in FIG. 5.

The sector of downstream annular envelope forms a channel which is open axially in the downstream direction, and it is fixed by fixing means to the sector of the upstream annular envelope. These fixing means may be a rivet. As shown in FIG. 3, the sector 5 of downstream annular envelope comprises holding means which are positioned axially upstream of the sector to hold the fuel injection manifold in place, and to hold the ventilation duct in place against the inside wall of the sector of upstream annular envelope, and to make a point connection between the sector of downstream annular envelope and the downstream surface of the sector of upstream annular envelope. The holding means are for example webs 54 (such as two webs per sector, for example) of a small circumferential width which are integrally cast with the sector of downstream annular envelope on the upstream side of the latter. A web 54 is shown in section in FIG. 3. The web 54 has an inner tongue 55 which extends axially upstream of the sector of downstream annular envelope so that, once the sector of downstream annular envelope is correctly positioned in the channel formed by the sector of upstream annular envelope, the said inner tongue 55 will press one of the tubes of the ventilation duct against the apex part of the channel. An outer tongue 56 of the web 54 defines, with the inner tongue 55, a concave secondary cavity 24 to receive the fuel injection manifold to hold the latter spaced a certain distance away from the upstream surface of the sector 5 of downstream annular envelope. Hence, the sector 5 of downstream annular envelope performs the function of a screen for thermal protection satisfactorily. The web 54 also has, at its inner and outer radial ends, tertiary cavities 57 which are to be lined up with holes formed in the sector of upstream annular envelope to allow studs 6 which pass through the holes to come to rest in the cavities. The studs 6 are welded to allow the sectors of upstream and downstream annular envelope to be fixed together. Other means for fixing the sectors of the upstream and downstream annular envelopes together may be envisaged to enable the screen for thermal protection to be removed for the purpose of maintaining the burner ring.

Figure 4:
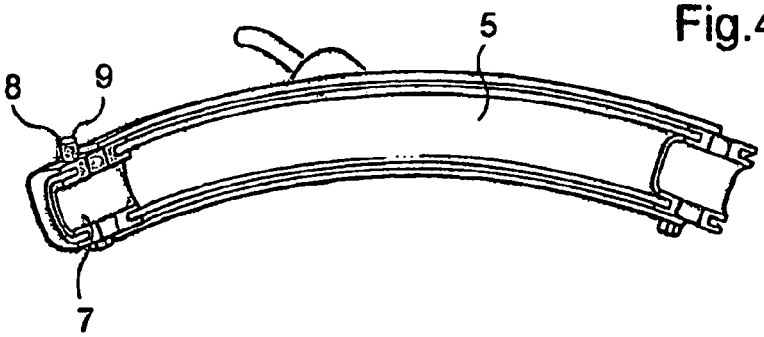
FIG. 4 is a perspective view of the sector of burner ring fitted with attached second connecting end-pieces at its ends.
Figure 5:
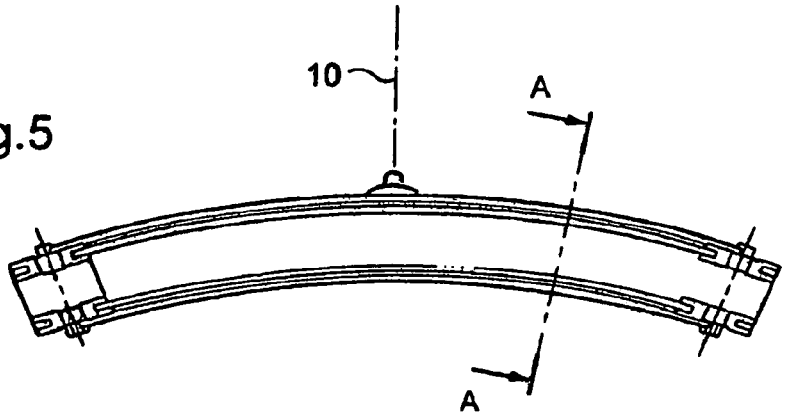
FIG. 5 is a view looking downstream of the sector of burner ring fitted with attached second connecting end-pieces at its ends.

FIGS. 4 and 5 show a sector of the burner ring which is fitted at its ends with second connecting end-pieces 7 for lateral attachment to enable the sector to be attached to another sector at each end. In this way, the sectors of ring are connected together by second connecting end-pieces for lateral attachment which comprise a part which is provided, at its ends facing the ends of the sectors of ring, with grooves into which the ends of the sectors of downstream annular envelope fit. The second connecting end-pieces 7 for lateral attachment are also used to fix the sectors of ring to the flameholder arms 22 by a pin 8 and retaining pin 9.

The presence of the second connecting end-pieces 7 for lateral attachment enables the sectors of ring to expand freely, since the ends of the latter are not held immobile. The rivet 10 does however enable the complete assembly to be held fixed in place.

The invention is not limited to the embodiments of fixing and attachment device which have been described above solely by way of example but does in fact cover any variant which might be envisaged by the person skilled in the art within the scope of the following claims.

The invention claimed is:

1. A burner ring for a turbofan jet engine, said engine producing both a flow of bypass air and a core flow, said ring having an axis of revolution coinciding with an axis of rotation of the engine, and said ring comprising a plurality of sectors connected together and each sector comprising:

an upstream annular envelope sector comprising:

a first channel which opens axially in a downstream direction;

an upstream surface configured to contact said core flow; and a bypass air inlet to deliver said flow of bypass air through an orifice of said upstream annular envelope sector;

a fuel injection manifold arranged in said first channel, said fuel injection manifold being fitted to a fuel inlet;

a ventilation duct which extends along said first channel for at least part of a length of said upstream annular envelope sector, said ventilation duct being positioned upstream of said fuel injection manifold, said ventilation duct being configured to emit said flow of bypass air to cool said fuel injection manifold;

a first connecting end-piece arranged in said first channel upstream of said fuel injection manifold to receive both said fuel inlet and said ventilation duct; and a downstream annular envelope sector arranged downstream of the fuel injection manifold to protect said fuel injection manifold.

2. The burner ring of claim 1, wherein said downstream annular envelope sector forms a second channel which opens axially in the downstream direction and is fixed to said upstream annular envelope sector.

3. The burner ring of claim 1, further comprising a holding device positioned substantially axially upstream of said downstream annular envelope sector, said holding device being configured to hold said fuel injection manifold in place relative to said downstream annular envelope sector, said holding device being configured to connect said downstream annular envelope sector to said upstream annular envelope sector.

4. The burner ring of claim 1, wherein said first connecting end-piece comprises a main cavity which forms a receptacle for said fuel inlet and said bypass air inlet.

5. The burner ring of claim 4, wherein said ventilation duct comprises a first perforated tube and a second perforated tube, said first and second tubes each comprising an open end, said first connecting end-piece comprising a first and second lateral openings, said first and second lateral openings being situated on either side of said main cavity, said main cavity being formed to allow the passing of said flow of bypass air into said first and second lateral openings, said open ends of said first and second tubes being held respectively in said first and second lateral openings.

6. The burner ring of claim 1, wherein said sectors are connected laterally by a plurality of second connecting end-pieces, each of said second connecting end-pieces comprising a second groove upon which a first groove on ends of said downstream annular envelope sector fit to enable a connection.

7. The burner ring of claim 1, wherein said first connection end-piece has an upstream surface with a curvature complementary to a curvature of a downstream surface of said upstream annular envelope sector.

8. An afterburner arrangement for a turbofan engine, said engine comprising the burner ring of claim 1, said afterburner arrangement comprising:

an annular outer casing;

an annular exhaust casing, said annular exhaust casing is spaced away from said annular outer casing, said annular exhaust casing is within said annular outer casing, said annular exhaust casing comprising: an inner annular wall and an outer annular wall, said inner and outer annular walls each have an axis of revolution that is the axis of revolution of the jet engine, said outer annular wall having a plurality of orifices;

a passage for said flow of bypass air, said passage defined by said outer annular wall and said annular outer casing;

a passage for the core flow is defined by the outer annular wall and the inner annular wall; and a flameholder arm, said upstream annular envelope sector is fixed to a downstream side of said flameholder arm by a second connecting end-piece.

9. The afterburner arrangement of claim 8, whereas each of said orifices of said outer annular wall comprises a section of a tube that is cast as one piece with the inner annular wall.

10. The afterburner arrangement of claim 8, whereas each said orifices of each of said upstream annular envelope sector coincides with and is fixed to one of the said orifice in the outer annular wall.

11. The afterburner arrangement of claim 8, whereas said first connecting end-piece has a shape complementary to that of said first channel of said upstream annular envelope sector.

12. The afterburner arrangement of claim 3, whereas said holding device is a web, said web comprising an inner tongue which extends axially upstream of said downstream annular envelope sector so that said inner tongue will press said ventilation duct against the first channel.

13. The afterburner arrangement of claim 12, whereas said web comprises an outer tongue that defines a secondary cavity to receive the fuel injection manifold and hold said fuel injection manifold a distance away from an upstream surface of said downstream annular envelope sector.

14. The afterburner arrangement of claim 1, whereas said downstream annular envelope sector is fixed to said upstream annular envelope sector via a rivet.

15. The afterburner arrangement of claim 12, whereas said web is cast as one piece with the upstream side of said downstream annular envelope sector.

16. An aircraft engine comprising an afterburner arrangement according to claim 8.

* * * * *